US008909099B2

(12) United States Patent
Maeshima

(10) Patent No.: US 8,909,099 B2
(45) Date of Patent: Dec. 9, 2014

(54) IMAGE FORMING APPARATUS

(71) Applicant: KYOCERA Document Solutions Inc., Osaka (JP)

(72) Inventor: Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 73 days.

(21) Appl. No.: 13/776,949

(22) Filed: Feb. 26, 2013

(65) Prior Publication Data

US 2013/0259525 A1 Oct. 3, 2013

(30) Foreign Application Priority Data

Mar. 29, 2012 (JP) ..... 2012-076314

(51) Int. Cl.
*G03G 21/16* (2006.01)
*G03G 15/08* (2006.01)

(52) U.S. Cl.
CPC ..... *G03G 15/0817* (2013.01); *G03G 15/0872* (2013.01); *G03G 15/0886* (2013.01)
USPC ..... 399/119; 399/106; 399/258

(58) Field of Classification Search
CPC ..... G03G 2215/0692; G03G 15/0839; G03G 21/1817; G03G 15/0879; G03G 21/1832
USPC ..... 399/106, 119, 120, 260
See application file for complete search history.

(56) References Cited

U.S. PATENT DOCUMENTS 5,402,216 A * 3/1995 Komaki et al. ..... 399/260
5,419,468 A * 5/1995 Taki ..... 222/554
5,734,953 A * 3/1998 Tatsumi ..... 399/262
6,564,029 B2 * 5/2003 Kojima et al. ..... 399/258
7,010,250 B1 * 3/2006 Yahagi ..... 399/258
7,627,273 B2 * 12/2009 Tanabe ..... 399/258
7,657,206 B2 * 2/2010 Sato ..... 399/119
8,180,262 B2 * 5/2012 Kawai ..... 399/258
8,571,447 B2 * 10/2013 Eto ..... 399/260

FOREIGN PATENT DOCUMENTS

JP 2003-270950 A 9/2003
JP 2005-316287 A 11/2005
JP 2010-066581 A 3/2010

OTHER PUBLICATIONS

English Abstract and Translation for JP 2003-270950 A, published Sep. 25, 2003.
English Abstract and Translation for JP 2005-316287 A, published Nov. 10, 2005.
English language Abstract and Translation for JP 2010-066581 A, published Mar. 25, 2010.

* cited by examiner

*Primary Examiner* — Clayton E Laballe
*Assistant Examiner* — Leon W. Rhodes, Jr.
(74) *Attorney, Agent, or Firm* — NDQ&M Watchstone LLP

(57) ABSTRACT

An image forming apparatus of the present disclosure includes a developing device, a support frame, a developer supply mechanism, and a shutter member. The developing device has a developer bearing member that supplies a developer to the image bearing member. The support frame is capable of disposing the developing device selectively at a mounting/demounting position and at a developing position. The shutter member opens a replenishment port formed at the connection portion in tandem with the movement of the developing device from the mounting/demounting position to the developing position and closes the replenishment port in tandem with the movement of the developing device from the developing position to the mounting/demounting position. A direction in which the developing device is moved is different from a direction in which the shutter member performs the opening/closing of the replenishment port.

6 Claims, 10 Drawing Sheets

IMAGE FORMING APPARATUS

INCORPORATION BY REFERENCE

This application is based on and claims the benefit of priority from Japanese Patent Application No. 2012-76314 (filed on Mar. 29, 2012).

BACKGROUND

The present, disclosure relates to an image forming apparatus including a demountable developing device, such as a copy machine, a facsimile, a printer, or the like and relates particularly to a connection structure between a developing device and a developer supply mechanism, that supplies a developer to the developing device.

Conventionally, for the sake of easy maintenance, a developing device incorporated in an image forming apparatus is tilled beforehand with a given amount of developer (toner) and upon running out of the developer, is replaced as a whole with a new one. Front the economical viewpoint, however, such replacement cannot be performed frequently, and hence, forming a somewhat large number of sheets of images necessarily requires an increase in developer capacity, rendering it difficult to achieve miniaturisation of a developing device of the above-described type. In order, therefore, to achieve miniaturization, of a developing device, there has been proposed a developing device of a type to which a developer is supplied from a developer supply mechanism such as a toner storage container, an intermediate hopper, or the like, which is provided independently of the developing device.

Furthermore, with respect to a ease where, due to a restriction on a layout inside ah image forming apparatus, a developer supply mechanism and a developing device cannot be disposed adjacently to each other, there has been known a configuration in which a flexible developer supply passage such as a toner feeding tube, a conveying pipe, or the like is provided to establish communication between a developer supply mechanism, and a developing device.

By the way, in the above-described image forming apparatus, in order to simplify replacement and maintenance of the developing device, preferably, only the developing device can be demounted, with the developer supply mechanism left mounted on a main body side of the image forming apparatus.

The configuration including the flexible developer supply passage such as a toner feeding tube, a conveying pipe, or the like, however, presents a problem that the flexible developer supply passage is flexibly connected to the developer supply mechanism and to the developing device, which results in poor connection, strength between the developer supply passage aid the developer supply mechanism or the developing device. Furthermore, in a case of a configuration in which a plug provided at a tip end of a toner feeding tube is connected to a swingable shaft of a developing unit every time the developing unit is mounted/demounted it is necessary that the plug be connected or disconnected, rendering an operation of mounting/demounting the developing unit complicated.

Moreover, in mounting/demounting the developing device in/from a main body of the image forming apparatus, in order to avoid interference between a developing roller (developer bearing member) and a photosensitive drum (image bearing member), if is necessary that the developing device be mounted/demounted in a slate where it has been moved to a position where the developing roller is separated by a prescribed distance from the photosensitive drum. When the developing device is at an operation position thereof, however, if there is a variation in positional relationship between the developing roller and the photosensitive drum an image failure might occur, furthermore, in moving the developing device, if a connection portion of the developer supply mechanism, which is connected to a developer supply port of the developing device, is fixed to the main body side of the image farming apparatus, moving the developing device might cause a deviation in positional relationship between, the connection portion and the developer supply port of the developing device, leading to a possibility that a connection failure occurs between the developing device and the developer supply mechanism or that, due to irregular rotation of the developing roller, there occurs a variation in positional relationship between the developing roller and the photosensitive drum.

Furthermore, even in a case where no such connection failure occurs, if an opening portion of the developer supply mechanism is being left opened at the time of mounting/demounting the developing device, there is a possibility dial a developer adhering to the opening portion drops into the main body of the image forming apparatus, causing contamination inside the apparatus.

SUMMARY

An image forming apparatus according to one aspect of the presets disclosure includes a developing device, a support frame, a developer supply mechanism, and a shutter member. The developing device has a developer bearing member that is disposed so as to be opposed to an image bearing member on which an electrostatic latent image is formed and, at a region, thereof opposed to the image hearing member, supplies a developer to the image bearing member. The support frame supports the developing device and is capable of disposing the developing device selectively at a mounting/demounting position where the developer bearing member is separated from the image beating member and a developing position where a developer can be supplied to the image bearing member. The developer supply mechanism supplies a developer to the developing device. The shutter member is fitted around a connection portion, of the developer supply mechanism at which the developer supply mechanism is connected to the developing device. The shutter member opens a replenishment port formed at the connection portion in tandem with the movement of the developing device from the mounting/demounting position to the developing position and closes the replenishment pen in tandem with the movement of the developing device from the developing position to the mounting/demounting position. A direction in which the developing device is moved is different from a direction in which the shutter member performs the opening/closing of the replenishment port.

Still other objects of the present disclosure and specific advantages provided by the present disclosure will be made further apparent from the following description of an embodiment.

DETAILED DESCRIPTION

Figure 1:
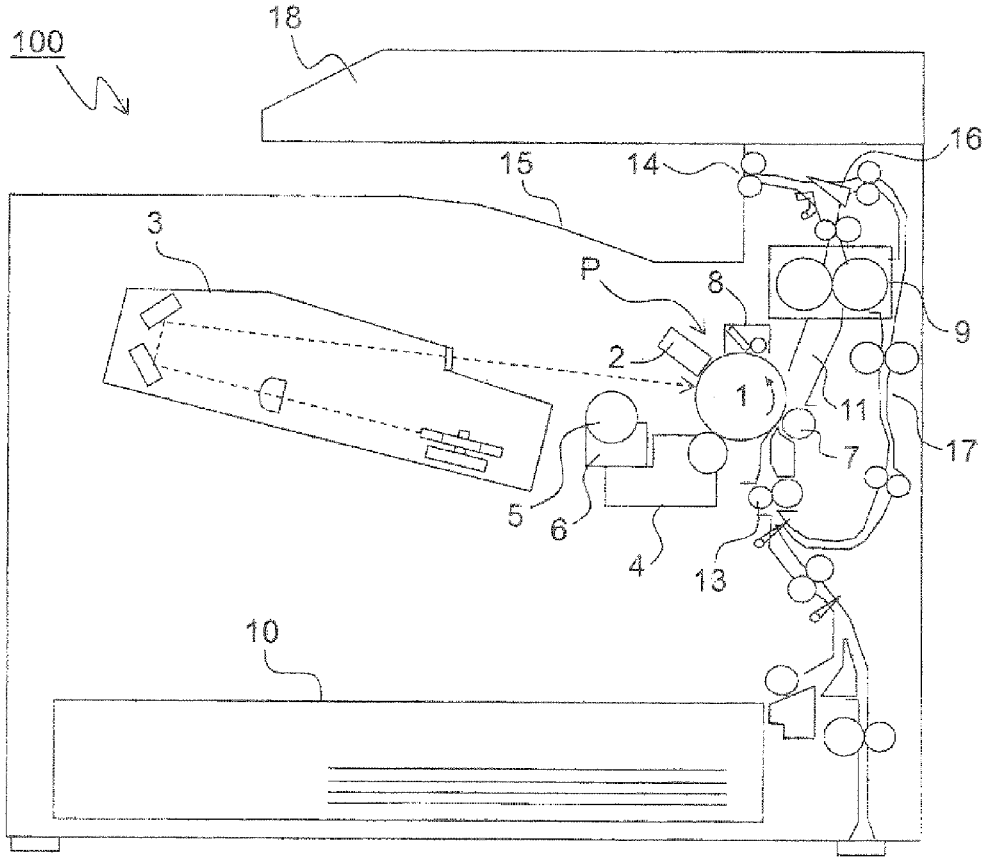
FIG. 1 is a schematic sectional view of an image forming apparatus 100 according to one embodiment of the present disclosure.

The following describes an embodiment of the present disclosure with reference to the appended drawings. FIG. 1 is a schematic sectional view of an image forming apparatus 100 according to one embodiment of the present disclosure, in a main body of the image forming apparatus (for example, a monochrome multifunctional peripheral) 100, an image forming part P that forms monochrome images through processing steps of charging, exposure, development, and image transfer is provided.

In the image forming part P, there are provided, along a rotation direction, of a photosensitive drum 1 (a counterclockwise direction in FIG. 1), a charging part 2, an exposure unit 3, a developing device 4, a transfer roller 7, a cleaning device 8, and a static eliminator (not shown). In the image forming part P, an image forming process with respect to the photosensitive drum 1 is executed while the photosensitive drum 1 is rotated, in the counterclockwise direction in FIG. 1.

The photosensitive drum 1 is formed by, for example, applying a photosensitive layer onto an aluminum drum, and the surface thereof is charged by the charging part 2. On the surface of the photosensitive drum 1 in an area where a laser beam from the after-mentioned exposure unit 3 is received, an electrostatic latent image having attenuated charge is formed. As the above-described photosensitive layer, though there is no particular limitation, preferably used is, for example, a layer of amorphous silicon (a-Si) having excellent durability, an organic photosensitive layer (OPC) that is suppressed in terms of from generation at the time of being charged and allows high-resolution images to be formed, or the like.

The charging part 2 uniformly charges the surface of the photosensitive drum 1. For example, as the charging part 2, there is used a corona discharging device in which a thin wife or the like is used as an electrode, and applying a high voltage to the electrode causes the charging part 2 to perform discharging. Instead of a corona discharging device, there may both used a contact-type charging device that applies a voltage while a charging member thereof represented by a charging roller being kept in contact with, the surface of a photosensitive member. Based on original document image data read at an image reading part 18, the exposure unit 3 irradiates the photosensitive drum 1 with a light beam (for example, a laser beam) to form an electrostatic latent image on the surface of the photosensitive drum 1.

The developing device 4 makes toner adhere to an electrostatic latent image on the photosensitive drum 1 to form a toner image thereon. Toner is supplied, to the developing device 4 from a toner container 5 via an intermediate hopper 6. Herein, a one-component developer (hereinafter, may be referred to simply as toner) made only of a toner component having a magnetic property is stored in the developing device 4. Furthermore, the developing device 4, the toner container 5, and the intermediate hopper 6 will be described later in more details.

The transfer roller 7 transfers a toner image formed on the surface of the photosensitive drum 1, without making any change thereto, onto a paper sheet conveyed along a paper sheet conveying path 11. The cleaning device 8 includes a cleaning roller, a cleaning blade, and so on that are placed in line contact with the photosensitive drum 1 along a longitudinal direction thereof, and after transfer of a toner image onto a paper sheet, it removes residual toner remaining on the surface of the photosensitive drum 1.

The image reading part 18 is composed of a scanning optical system that incorporates therein a scanner lamp that illuminates an original document at the time of copying and a mirror that changes an optical path of reflected light form an original document, a condenser lens that condenses reflected light from, an original, document to form an image, a CCD sensor that converts formed image light into an electric signal, and so on (none of these is shown. The image reading part 18 reads an original document image and converts it into image data.

In a case of performing a copying operation, at the image reading part 18, image data of an original document is read and converted into an image signal. Meanwhile, at the image forming part P, the photosensitive drum 1 being rotating in the counterclockwise direction in the figure is uniformly charged by the charging part 2. Then, based on the original document image data read at the image reading part 18, the exposure unit 3 emits a laser beam (light ray) onto the photosensitive drum 1, and thus an electrostatic latent image based, on that image data is formed on the surface of the photosensitive drum 1. After that, the developing device 4 makes toner adhere to the electrostatic latent image, and thus a toner image is formed.

Toward the image forming part P where the toner image has been formed as described above, a paper sheet is conveyed at prescribed timing from a paper sheet storage part 10 by passing through the paper sheet conveying path 11 and a registration roller pair 13. At the image forming part P, by the transfer roller 7, the toner image on the surface of the photosensitive drum 1 is transferred onto the paper sheet. Then, the paper sheet onto which the toner image has been transferred is separated from the photosensitive drum 1 and conveyed to a fixing part 9 where the paper sheet is then heated and pressed, and thus the toner image is fixed, onto the paper sheet.

The paper sheet that has passed through the fixing part 9 is conveyed in a direction set by a conveying guide member 16 that is disposed at a branching point in the paper sheet conveying path 11 to be ejected directly (or after having been sent to a reversing conveying path 17 and thus having undergone doable-sided copying thereon) onto a paper sheet ejection part 18 via an ejection roller path 14.

Figure 2:
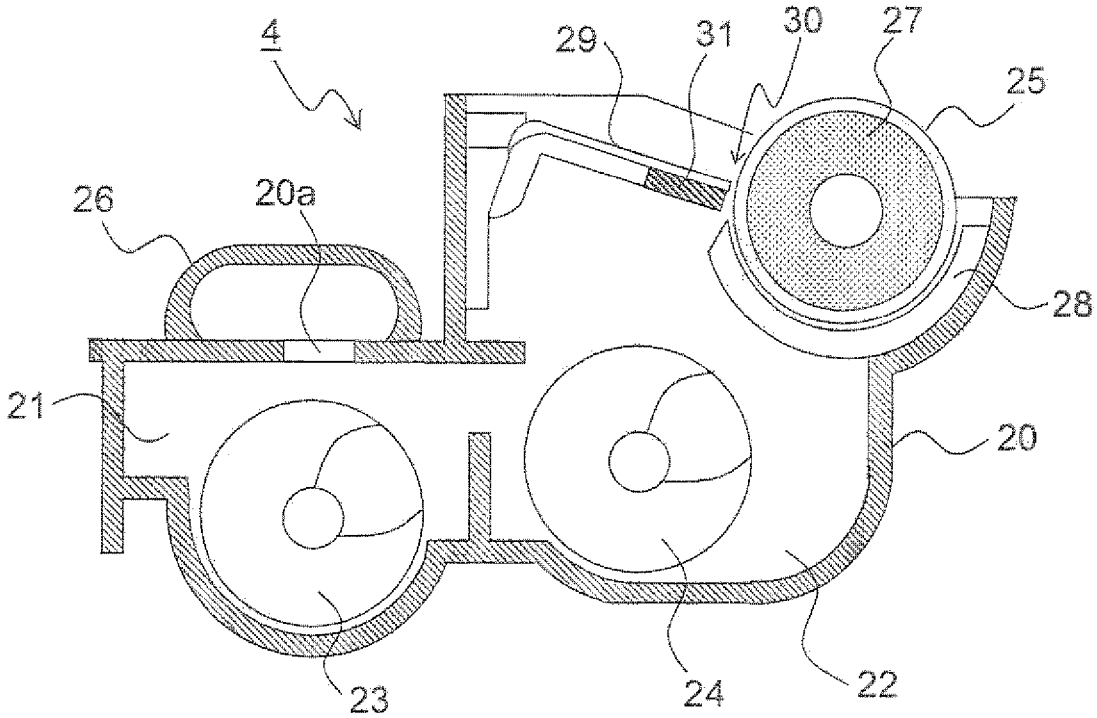
FIG. 2 is a side sectional view of a developing device 4 incorporated in the image forming apparatus 100 of the present disclosure.

FIG. 2 is a side sectional view of the developing device 4. As shown in FIG. 2. In a developing tank 20, a first reservoir chamber 21 and a second reservoir chamber 22 are formed by partitioning the developing tank 20 with a partition wall (not shown) formed integrally with, the developing, tank 20. A first stirring screw 23 is provided in the first reservoir chamber 21, and a second stirring screw 24 is provided in the second reservoir chamber 22. At an upper portion of the developing tank 20, a toner supply port 20*a* is provided. In accordance with a result of detection by a toner sensor (not shown) that detects the amount of toner in the developing tank 20, toner stored in the toner container 5 (see FIG. 1) is supplied through the toner supply port 20*a* into the developing tank 20 via the intermediate hopper 6 (see FIG. 1). Furthermore, a guide portion 26 to which an after-mentioned toner conveying passage 70 (see FIG. 4) is connected is provided so as to enclose the toner supply port 20*a*.

Each of the first stirring screw 23 and the second stirring screw 24 has a support shaft as a center thereof around, which a spiral vane is provided. The first stirring screw 23 and the second stirring screw 24 are each rotatably and axially supported in the developing tank 20 so as to be parallel to each other. The partition wall does not exist at both end portions of the developing tank 20 in a longitudinal direction thereof (a direction perpendicular to the plane of FIG. 2) that is an axial direction of each of the first stirring screw 23 and the second stirring screw 24, thus allowing toner passing between the first stirring screw 23 and the second stirring screw 24. Thus, the first stirring screw 23 conveys, while stirring, toner in the first reservoir chamber 21 to the second reservoir chamber 22. Furthermore, the second stirring screw 24 conveys, while stirring, toner that has been conveyed to the second reservoir chamber 22 and supplies it to a developing roller 25.

The developing roller 25 is rotatably and axially supported in the developing tank 20 so as to be parallel to the first stirring screw 23 and the second stirring screw 24 inside the developing roller 25, a magnet body 27 constituted by a permanent magnet having a plurality of magnetic poles is fixed. Under a magnetic force of the magnetic body 27, toner is made to adhere to (borne on) the surface of the developing roller 25, and thus a toner thin layer is formed thereon. The developing roller 25 is exposed at part of an outer peripheral surface thereof from the developing tank 20 and is disposed so that a portion thereof thus exposed is opposed to the photosensitive drum 1 (see FIG. 1).

The developing roller 25 on which the toner thin layer has been formed rotates following the rotation of the photosensitive drum 1, so that the toner is supplied onto the photosensitive layer of the photosensitive drum 1. Each of the first stirring screw 23, the second stirring screw 24, and the developing roller 25 is driven to rotate at a prescribed, speed by a motor (not shown) through a gear train. Furthermore, at each of both end portions of the developing roller 25, a magnetic seal member 28 for preventing developer leakage through a gap between the developing tank 20 and the developing roller 25 is provided.

A restriction blade 29 is formed to have a width in a longitudinal direction thereof larger than a maximum development width of the developing roller 25. The restriction blade 29 is disposed to be spaced by a prescribed clearance from the developing roller 25, thus forming a layer thickness restriction portion 30 that restricts the amount of toner to be supplied to the photosensitive drum 1. A gap constituting the layer thickness restriction, portion 30 is set to about 0.2 mm to 0.4 mm. As a material of the restriction blade 29, magnetic or non-magnetic SUS (stainless steel) or the like is used. Herein, a permanent magnet 31 is attached to the restriction blade 29, which is a magnetic member, so as to impart a magnetic property thereto.

The magnet body 27 has a plurality of magnetic poles (not shown) that are an N pole and an S pole. The restriction blade 29 is opposed to the magnetic poles of the magnet body 27, and thus magnetism is concentrated at a tip end of the restriction blade 29, so that a magnetic field in such a direction that the restriction, blade 29 and the magnet body 27 are attracted to each other is generated at the layer thickness restriction portion 30.

Under the action, of this magnetic field, a toner chain, (magnetic brush) that is a sequence of toner particles is formed between the restriction blade 29 and the developing roller 25. The toner chain is subjected to layer restriction by passing through the layer thickness restriction portion 30, and thus a toner thin layer is formed on the developing roller 25. Since the permanent magnet 31 is disposed at the restriction blade 29, the restriction is achieved not only by the clearance constituting the layer thickness restriction portion 30 but also by the magnetic field generated at the layer thickness restriction portion 30 and thus is enhanced to such a degree that a toner thin layer of several tens of micrometer (μm) in thickness is formed on the developing roller 25. Residual toner left unused for the formation of the toner thin layer, on the other hand, builds up along a side surface of the restriction blade 29 on an upstream side (the lower side in FIG. 2). After that, when, as a result of the rotation of the developing roller 25 in a clockwise direction in FIG. 2, the toner chain is moved to a position, where it is opposed to the photosensitive drum 1, the toner chain, while being kept at a given distance from, the surface of the photosensitive drum 1, forms a toner image.

Figure 3:
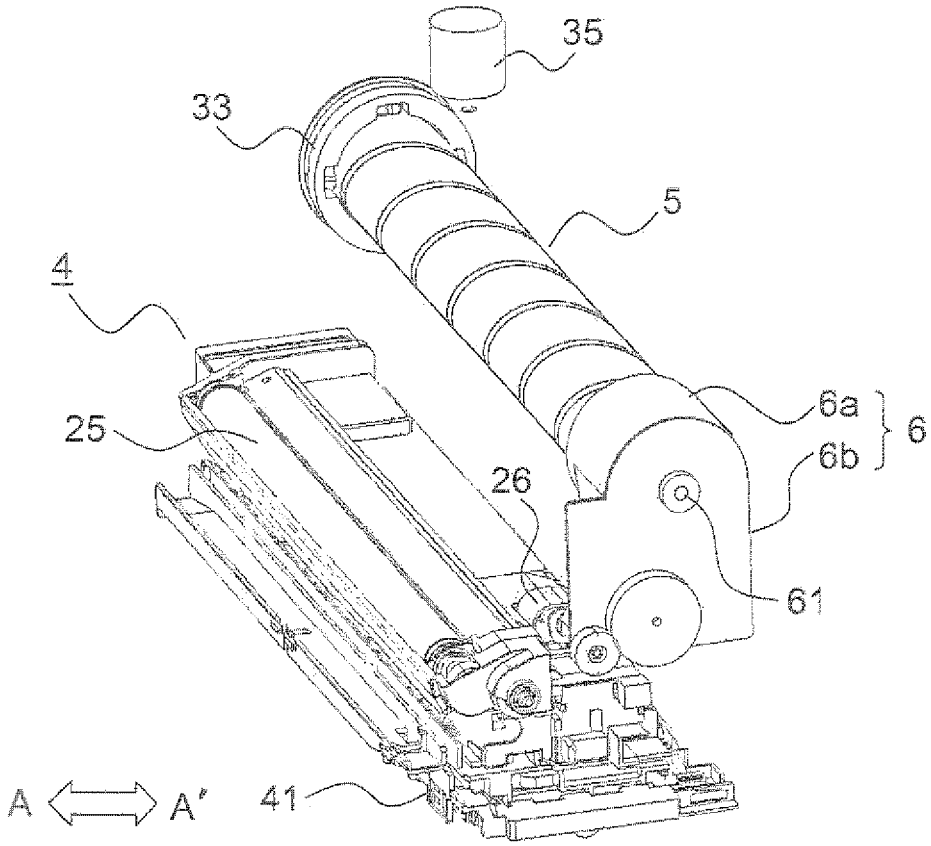
FIG. 3 is an external perspective view showing a positional relationship among the developing; device 4, a toner container 5, and an intermediate hopper 6 in the image forming apparatus 100 shown in FIG. 1.
Figure 4:
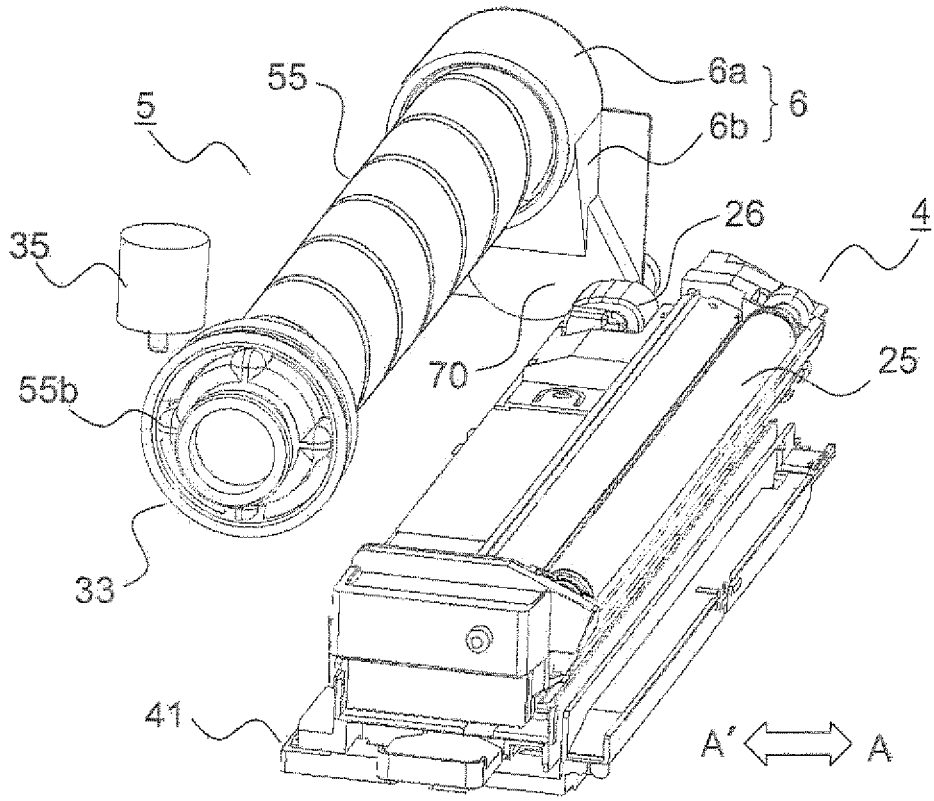
FIG. 4 is an external perspective view showing the positional relationship among the developing device 4, the toner container 5, and the intermediate hopper 6 in the image forming apparatus 100 of the present disclosure, in a state seen from the rear side of FIG. 1.
Figure 5:
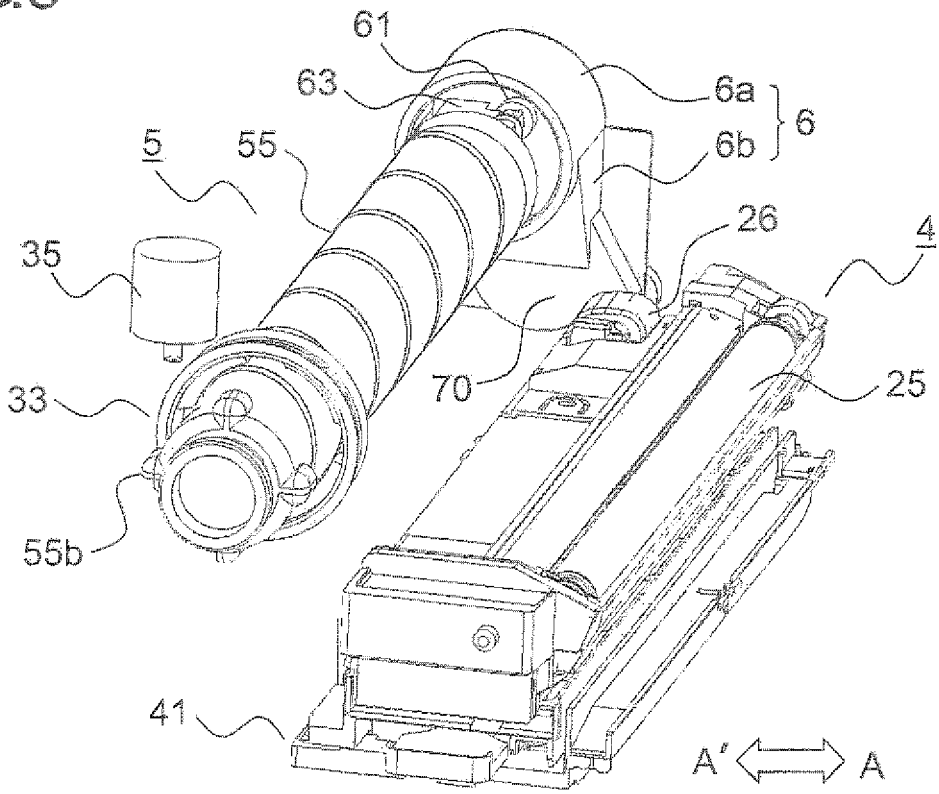
FIG. 5 is an external perspective view showing a state where the toner container 5 has been demounted from the state shown in FIG. 4.

Each of FIGS. 3 and 4 is an external perspective view showing a positional relationship among the developing device 4, the toner container 5, and the intermediate hopper 6 in the image forming apparatus 100 shown in FIG. 1, and FIG. 5 is an external perspective view showing a state where the toner container 5 has been demounted from the state shown in FIG. 4, FIG. 3 shows the developing device 4, the toner container 5, and the intermediate hopper 6. In a state seen from the back side of the image forming apparatus 100 (the rear side of FIG. 1).

The developing device 4 is placed on a support frame 41 that is configured, to be movable in a horizontal direction (direction of arrows A and A') with respect to the main, body of the image forming apparatus 100 (see FIG. 1). When the support frame 41 is moved in an arrow A direction, the developing device 4 is disposed at a position where the developing roller 25 is opposed via a predetermined gap to the photosensitive drum 1 and can supply toner to the photosensitive drum 1 (hereinafter, referred to as a developing position). On the other hand, when the support frame 41 is moved in an arrow A' direction, the developing device 4 is disposed at a position where die developing roller 25 is separated from the photosensitive drum 1 and can be mounted in/demounted from the main body of the image forming apparatus 100 (hereinafter, referred to as a mounting/demounting position).

The developing device 4, when disposed at the mounting/demounting position, is inserted or pulled out in a direction perpendicular to the plane of FIG. 4 along a bottom surface portion of the support frame 41, thus achieving engagement with and disengagement from (being mounted to/demounted from) the support frame 41. Furthermore, when the developing device 4 is disposed at the developing position, toner supply from, the developing device 4 to the photosensitive drum 1 is enabled. A mechanism for moving the support frame 41 will be described later.

The intermediate hopper 6 is fixed to the main body of the image forming apparatus 100 and is composed of a hopper upper portion 6*a* into which the toner container 5 is fitted and a hopper lower portion 6*b* that is connected to the hopper upper portion 6*a*. In the hopper upper portion 6*a*, there are disposed a rotary shaft 61 on which the loner container 5 is rotatably supported and a paddle 63 that rotates together with the toner container 5 around the rotary shaft 61. The toner conveying passage 70 for conveying toner to the toner supply port 20*a* of the developing device 4 is connected to the hopper lower portion 6*b* so as to protrude downward, and the inside of the hopper lower portion 6*b* communicates with the inside of the toner conveying passage 70. The toner conveying passage 70 is made of a material having rigidity, and inside the toner conveying passage 70, a spiral (not shown) for transporting toner in the intermediate hopper 6 to the developing device 4 is disposed.

The toner container 5 has a cylindrical container main body 55, and at each of four locations at one end portion of the container main body 55 on an outer peripheral surface thereof, an engagement convex portion 55*b* is provided, in a protruding manner. On the other hand, on a main body side of the image forming apparatus 100, a ring-shaped coupling 33 that is to be engaged with the engagement convex portion 55*b* and a motor 35 that drives the coupling 33 to rotate are disposed.

An end portion 70*a* of the toner conveying passage 70 on the side of the developing device 4 (see FIG. 11) is slidably insetted into the guide portion 26 of the developing device 4. By this configuration, the guide portion 26 functions as a linking member that connects the developing device 4 to the toner conveying passage 70 so that the developing device 4 is horizontally movable with respect thereto, and to-and-fro movement, (parallel movement) of the support frame 41 in the direction of arrows A and A' is allowed, with the intermediate hopper 6 and the toner convoying passage 70 fixed in place.

Figure 6:
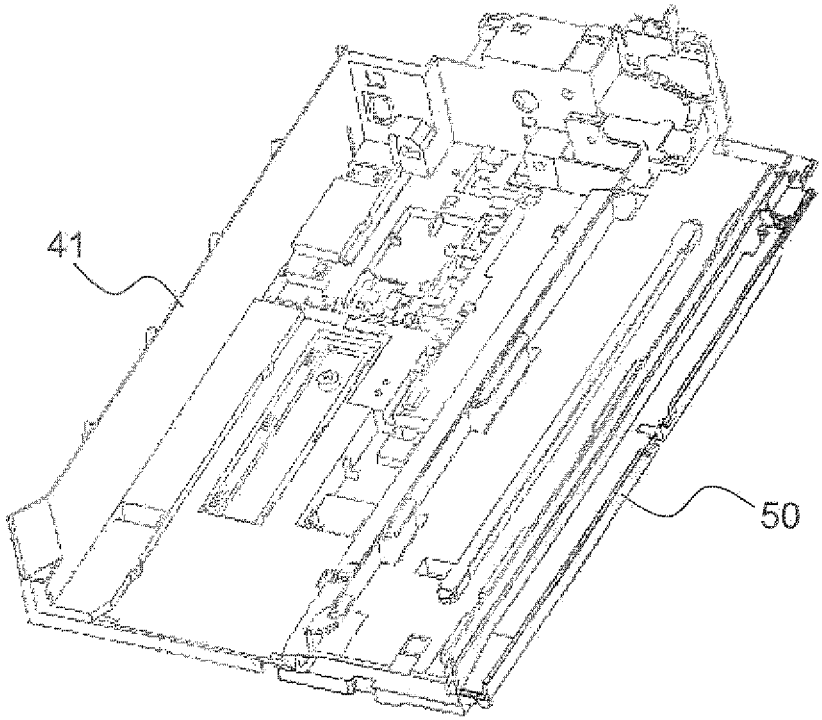
FIG. 6 is a perspective view showing a state where a support frame 41 is connected to a frame fixing member 50 that is disposed on a main body side of the image forming apparatus 100.
Figure 7:
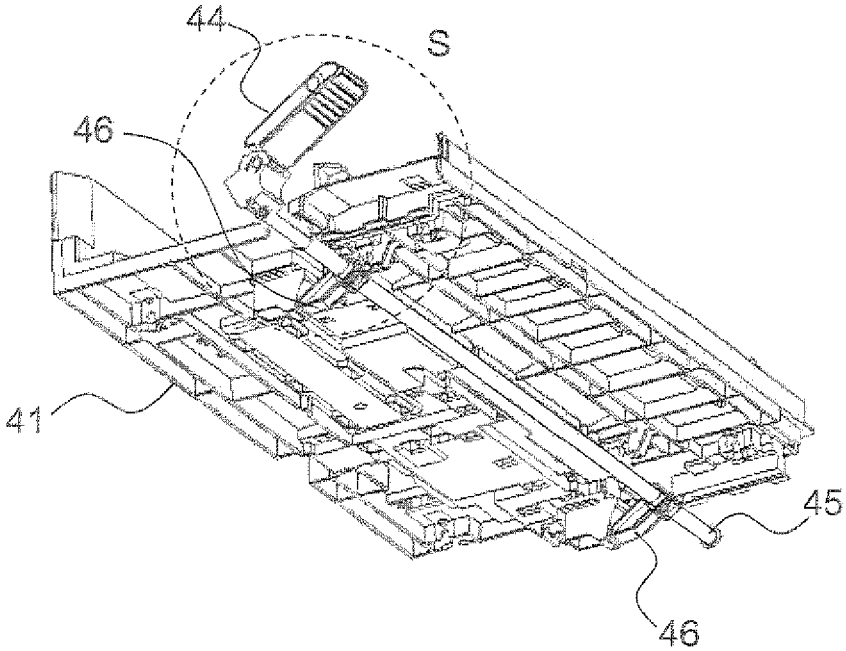
FIG. 7 is a perspective view of the support frame 41 and a developing release lever 44 as seen, from below.
Figure 8:
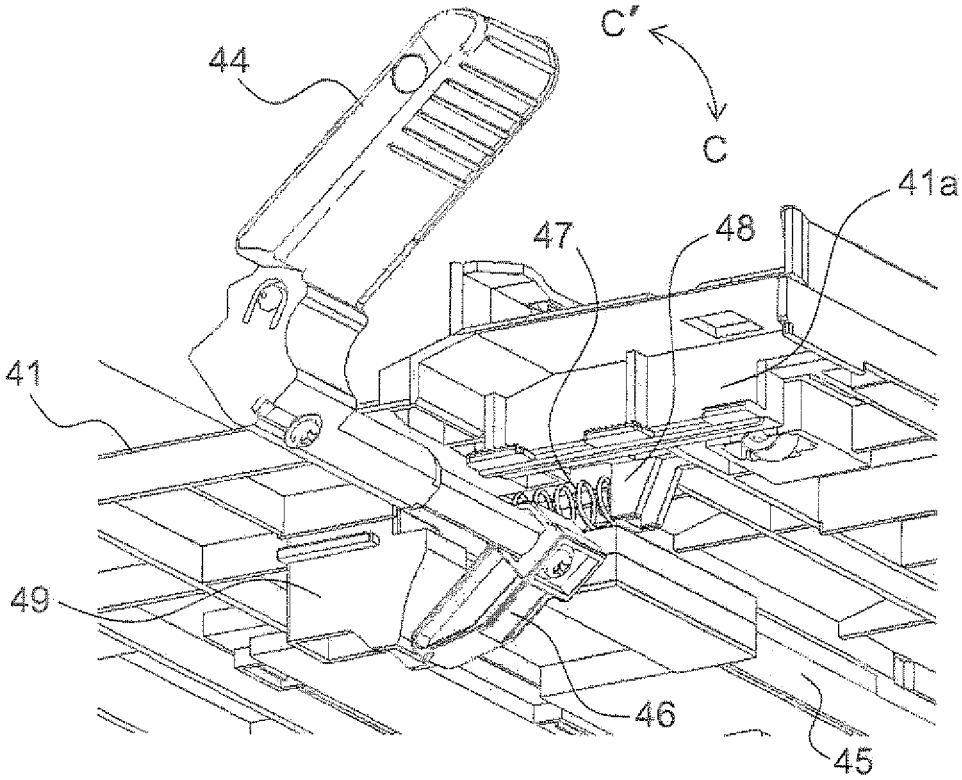
FIG. 8 is a partially enlarged view of the periphery of one of both log portions 46 shown in FIG. 7.
Figure 9:
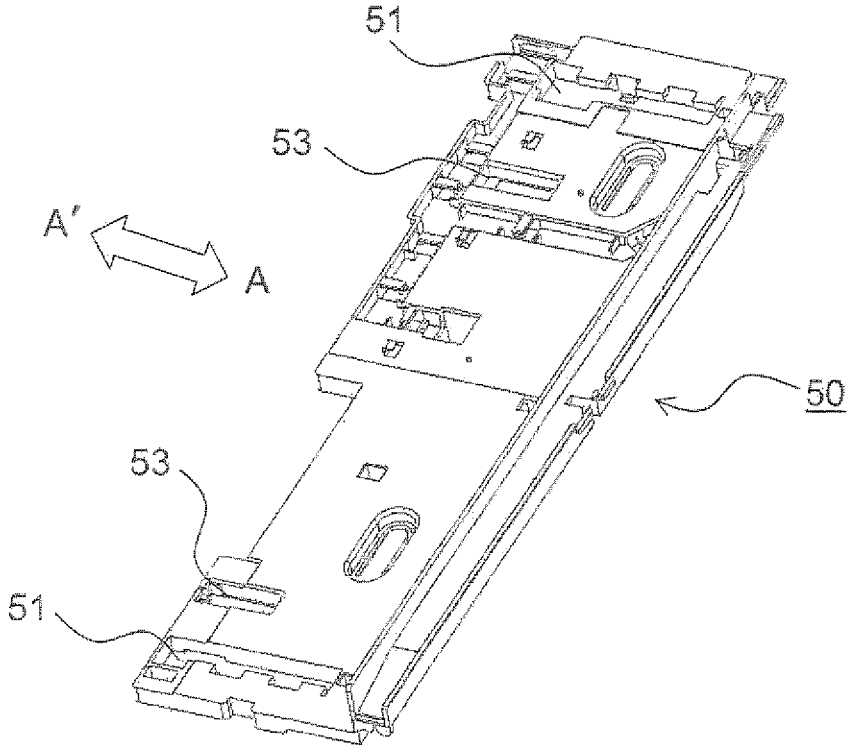
FIG. 9 is a perspective view of the frame fixing member 50 as seen from above.

Next, a description is given of the mechanism for moving the support frame 41. FIG. 6 is a perspective view showing a state where the support frame 41 is connected to a frame fixing member 50 that is disposed on die main body side of the image forming apparatus 100, and FIG. 7 is a perspective view of the support frame 41 and a developing release lever 44 as seen from below. FIG. 8 is a partially enlarged view of the periphery of one of both log portions 46 shown in FIG. 7 (within a broken line circle in FIG. 7), and FIG. 9 is a perspective view of the frame fixing member 50 as seen flow above. In FIG. 6, the developing release lever 44 is omitted to be shown.

The developing release lever 44 is fixed to one end of a shaft 45 that is rotatably supported at the lower side of the support frame 41. The two lug portions 46 are provided in the vicinities of both end portions of the shaft 45, respectively, and operating the developing release lever 44 rotates the shaft 45 and the lug portions 46. On the rear side of the support frame 41, there are formed a pair of rail portions 41*a*, a pair of spring bearing portions 48 that each receive one end of a coil spring 47, and a pair of protruding portions 49 that are disposed so as to be opposed to the lug portions 46, respectively.

The frame fixing member 50 is fixed to the main body side of the image forming apparatus 100, and in the frame fixing member 50, there are formed a rah engagement groove 51 with which each of the rail portions 41*a* of the support frame 41 is to be engaged and a spring space 53 for housing the coil spring 47. That is, the coil spring 47 is in contact at both ends thereof with each of the spring hearing portions 48 and with a left end inner wall surface of the spring space 53, so that, normally, a biasing force in such a direction as to approach the frame fixing member 50 (arrow A direction) acts on each of the spring bearing portions 48 of the support frame 41.

When the developing release lever 44 is swung, in an arrow C direction from the state shown in FIG. 8, the shaft 45 and the lug portions 46 also rotate in the same direction, so that respective tip ends of the lug portions 46 press against respective side surfaces of the protruding portions 49. This causes the support frame 41 to be moved in the arrow A' direction, and thus the developing device 4 (see FIG. 4) is disposed at the mounting/demounting position. Furthermore, along with the support frame 41, the spring bearing portions 48 also are moved in the arrow A direction, so that the coil spring 47 is pressed against the left end inner wall surface of the spring space 53 and thus is compressed.

Next, when the developing release lever 44 is swung in an arrow C direction so as to be brought back to the state shown in FIG. 8, the shaft 45 and the lug portions 46 also rotate in the same direction, so that the respective tip ends of the lug portions 46 are separated from the respective side surfaces of the protruding portions 49. As a consequence, the coil spring 47 that has been compressed expands and presses against each of the spring bearing portions 48 to cause the support frame 41 to be moved in the arrow A direction, and thus the developing device 4 (see FIG. 4) is disposed at the developing position.

Figure 10:
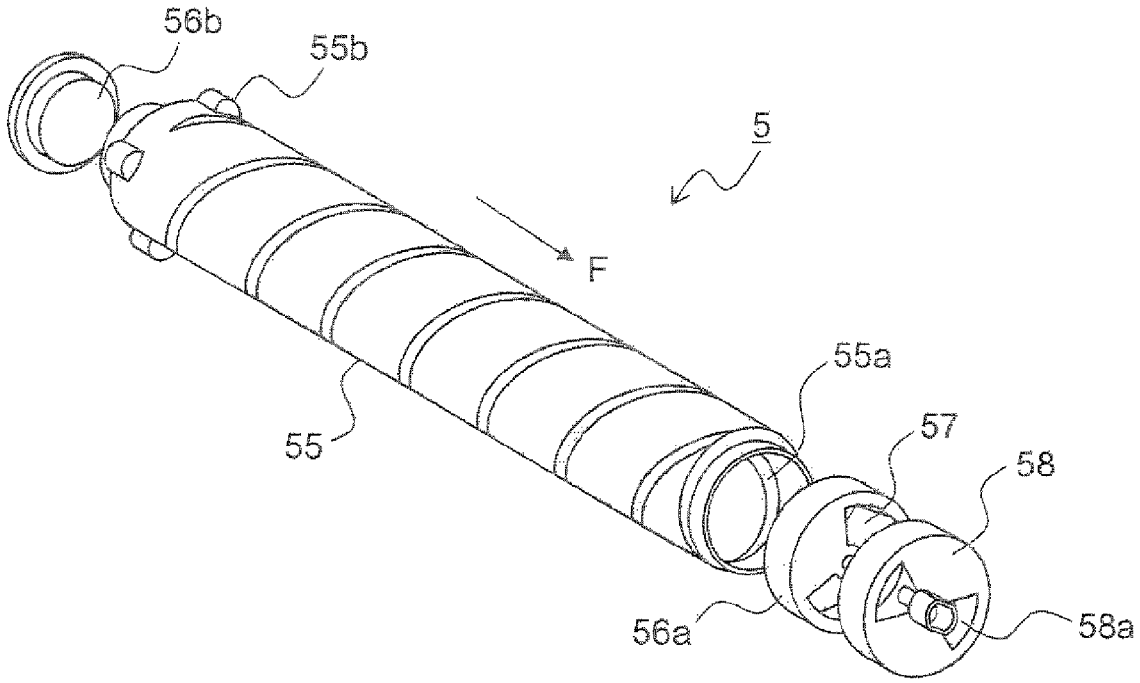
FIG. 10 is an exploded perspective view of the toner container 5.

FIG. 10 is an exploded perspective view of the toner container 5. The toner container 5 has the cylindrical container main body 55 and caps 56*a* and 56*b* that are attached to both end portions of the container main body 55, respectively. A spiral rib 55*a* is formed on an inner wall surface of the container main body 55. Furthermore, on the outer peripheral surface of the container main body 55 at the end portion thereof (the kit end in FIG. 10) positioned on the front side of the image forming apparatus 100, the engagement convex portion 55*b* to be engaged with the coupling 33 (see FIG. 3) for driving the toner container 5 to rotate is provided in a protruding manner.

The cap 56*a* on the side of the intermediate hopper 6 has two fan-shaped toner outlet ports 57. Furthermore, on an outer side of the cap 56*a*, a container shutter 58 having openings 58*a* of substantially the same shape as that of the toner outlet ports 57 is disposed. The cap 56*b* on the side of the coupling 33 is attachable m/detachable from the container main body 55, and toner is filled into the container main body 55, with the cap 56*b* detached.

When the toner container 5 supported, on the rotary shaft 61 (see FIG. 5) of the intermediate hopper 6 is rotated in a positive direction (rotated in a clockwise direction in FIG. 10), through phase advancement of the rib 55*a*, toner stored in the container main body 55 is gradually moved along an axial, direction (arrow F direction) from the side of the cap 56*b* to the aide of the cap 56*a* (side of the intermediate hopper 6). Furthermore, when the container main body 55 rotates in the positive direction, the openings 58*a* of the container shutter 58 are disposed at positions where they positional) coincide with the toner outlet ports 57 of the cap 56*a*, respectively.

Thus, by rotating the container main body 55 in the positive direction, toner in the container main body 55 is supplied to the intermediate hopper 6 through the toner outlet ports 57 and the openings 58*a*. On the other band, when the container main body 55 is rotated, in a reverse direction, the openings 58*a* of the container shutter 58 are moved to positions where they do not positionally coincide with the toner outlet ports 57 of the cap 56*a*, and thus the toner outlet ports 57 are closed.

Figure 11:
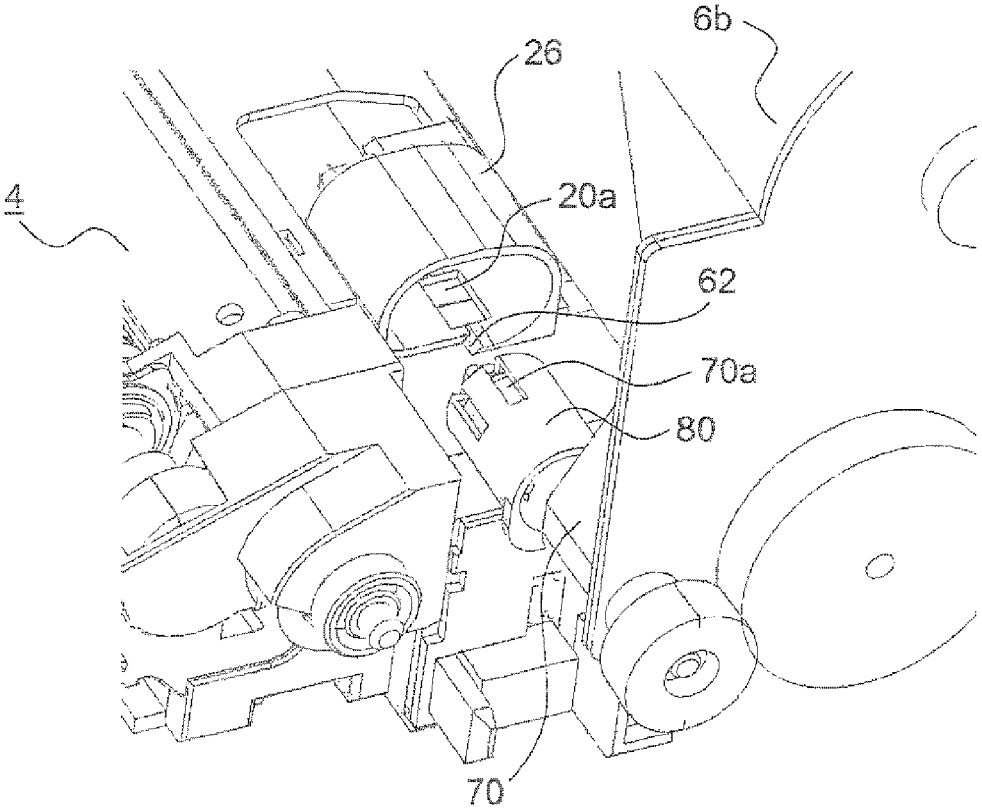
FIG. 11 is a perspective view of a connection area between the developing device 4 and a toner conveying passage 70 as seen from above.

FIG. 11 is a perspective view of a connection area between the developing device 4 and the toner conveying passage 70 as seen from above. As shown in FIG. 11, a shutter member 80 is rotatably and externally fitted around the end portion 70*a* of the toner conveying passage 70 on the side of the developing device 4. Furthermore, a replenishment port 71 (see FIG. 15) is open at a lower portion of the end portion 70*a*. The end portion 70*a* around which the shutter member 80 is fitted is inserted into the guide portion 26, and thus the developing device 4 is connected to the toner conveying passage 70. As the developing device 4 is horizontally moved in the direction of arrows A and A', the shutter member 80 is horizontally moved while rotating within the guide portion 26, thus opening/closing the replenishment port 71.

Figure 12:
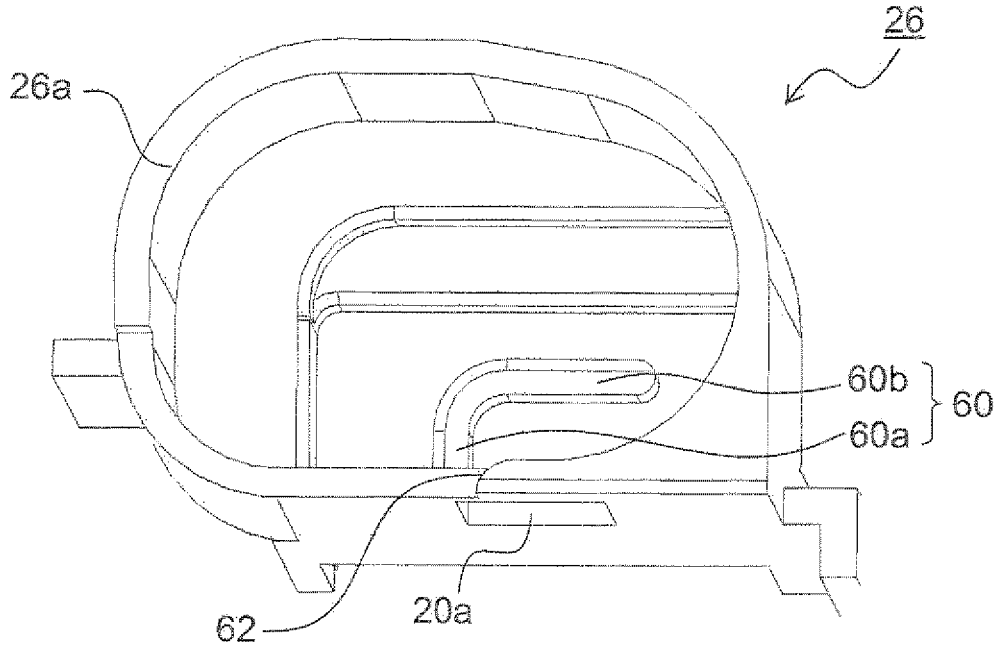
FIG. 12 is a perspective view of a guide portion 26 provided in the developing device 4.
Figure 13:
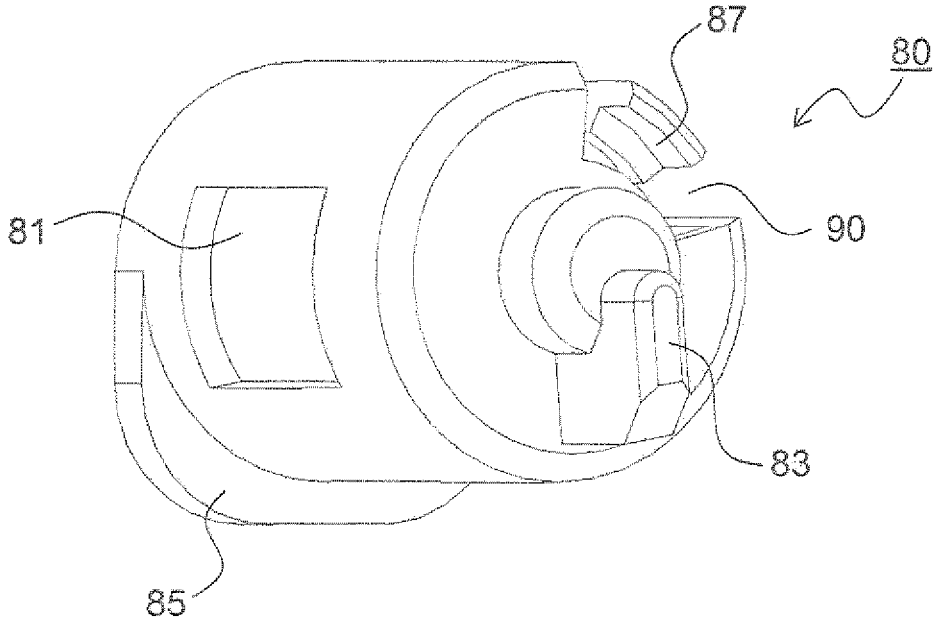
FIG. 13 is a perspective view of a shutter member 80 to be fitted to the toner conveying passage 70.

FIG. 12 is a perspective view of the guide portion 26 provided in the developing device 4, and FIG. 13 is a perspective view of the shutter member 80 to be fitted to the toner conveying passage 70. As shown, in FIG. 12, the guide portion 26 is formed in the shape of a barrel having a substantially oval section, and is open at one end thereof (in front with respect to the plane of FIG. 12) through which the shutter member 80 is inserted. The toner supply port 20*a* is formed, through a lower surface of the guide portion 26, and on an inner wall surface of the guide portion 26 at the back thereof a guide groove 60 that is bent into an L-shape and composed of a vertical groove portion 60*a* and a lateral groove portion 60*b* is formed. Furthermore, a level difference portion 62 is formed by making a cut depth-wise to remove substantially the half (the left half in FIG. 12) of a lower portion of an opening edge 26*a*.

As shown in FIG. 13, the shutter member 80 is formed in the shape of a cylinder and is open at one end thereof (the left, end in FIG. 13) through which the end portion 70*a* of the toner conveying passage 70 is inserted. A rectangular opening portion 81 is formed on an outer peripheral surface of the shutter member 80 and at a tip end portion of the shutter member 80, a protrusion 83 that extends in a radial direction from a center axis of the cylinder is provided in a protruding manner. Furthermore, at an opening edge of the shutter member 80, a flange portion 85 that protrudes in the same direction as the extending direction of the protrusion 83 is formed.

Moreover, the shutter member 80 has a lug portion 87 to be engaged with the end portion 70*a* of the toner conveying passage 70. The lug portion 87 rotatably engages the shutter member 80 with the end portion 70*a* and prevents the shutter member 80 from coming off from the end portion 70*a*.

Figure 14A:
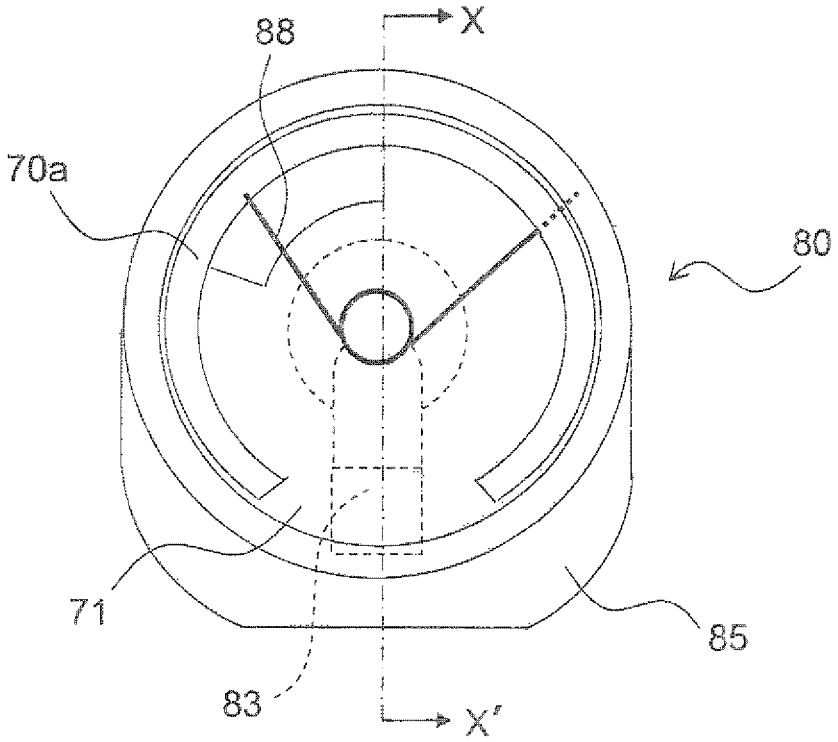
FIG. 14A is a plan view of an end portion 70*a* of the toner conveying passage 70, around which the shutter member 80 is fitted, as seen, from the side of the toner conveying passage 70.
Figure 14B:
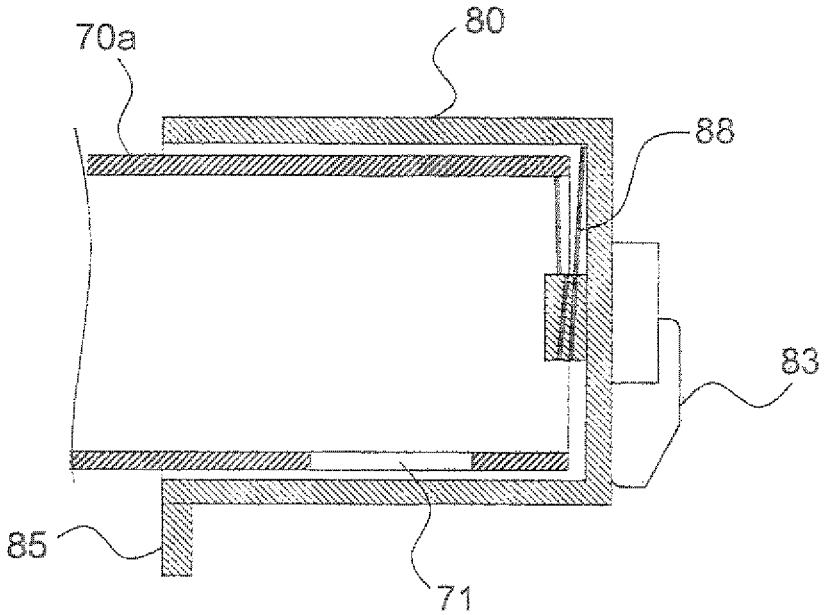
FIG. 14B is a side sectional view of the end portion. 70*a* of the toner conveying passage 70, around which the shutter member 80 is fitted.

FIG. 14A is a plan view of the end portion 70*a* of the toner conveying passage 70, around which the shutter member 80 is fitted, as seen from the side of the toner conveying passage 70 and FIG. 14B is a side sectional view (a sectional view taken along a line of arrows X and X' in FIG. 14A) of the end portion 70*a* of the toner conveying passage 70, around which the shutter member 80 is fitted. As shown in FIGS. 14A and 14B, a torsion spring 88 (biasing member) is disposed between, the end portion 70*a* of the toner conveying passage 70 and the shutter member 80. The torsion spring 88 is fixed at one end thereof to the end portion 70*a* and at the other end thereof to the shutter member 80. Before insertion of the developing device 4, under a biasing force of the torsion spring 88, the shutter member 80 is kept in such a posture that, as shown in FIG. 13, the protrusion 83 is perpendicularly oriented.

Figure 15:
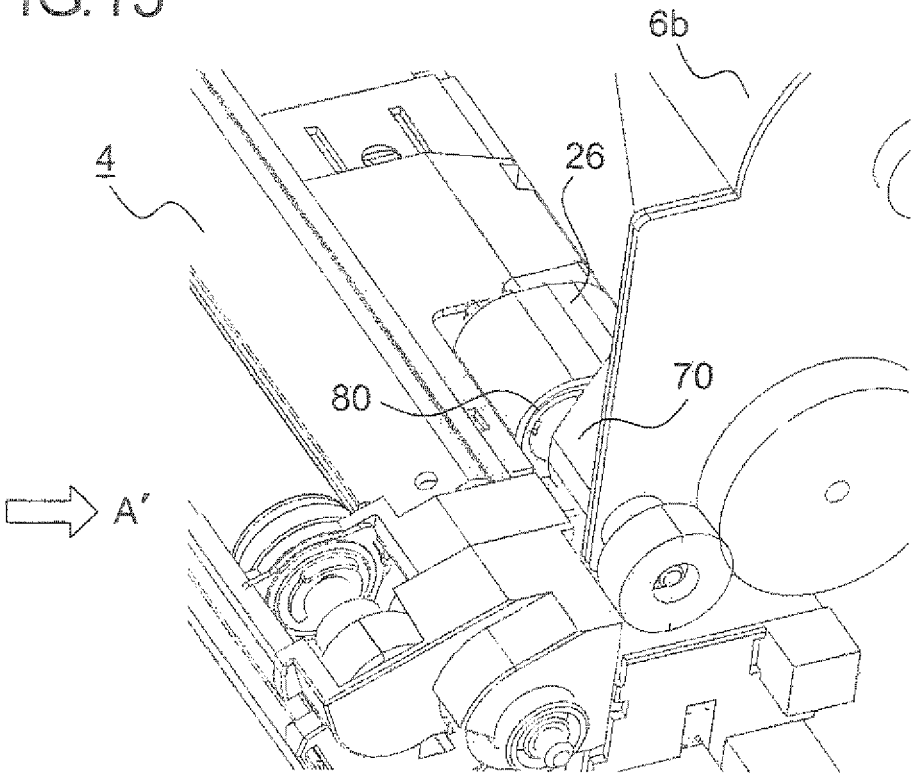
FIG. 15 is a perspective view, as seen from above, of the connection area between the developing device 4 and the toner conveying passage 70 when the developing device 4 has been moved to a mounting/demounting position, thereof.
Figure 16:
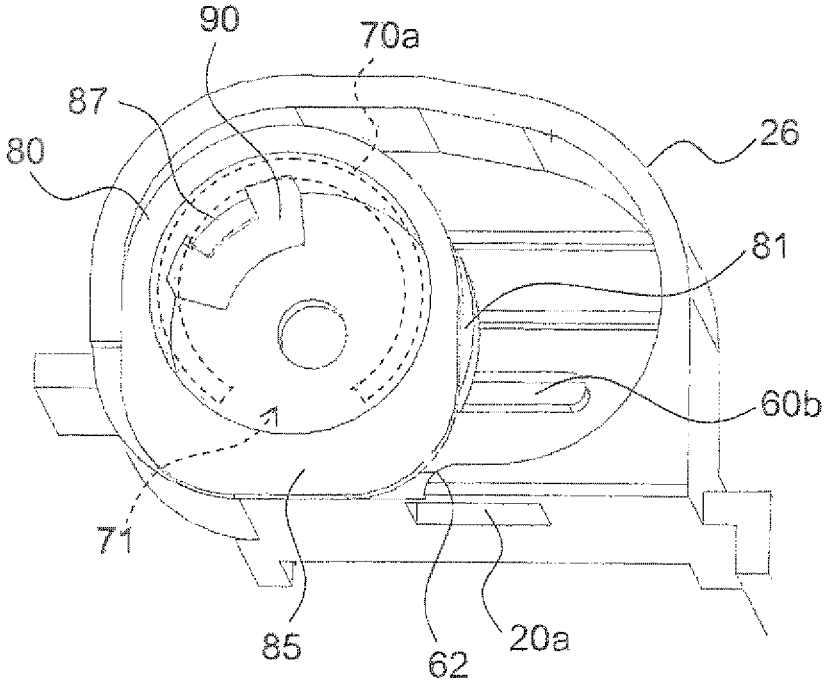
FIG. 16 is a perspective view showing a positional relationship between the guide portion 26 and the shutter portion 80 when the developing device 4 has been moved to the mounting/demounting position.

Next, a detailed description is given of a mechanism in which the replenishment port 71 is opened/closed by the shutter member 80. FIG. 15 is a perspective view, as seen from above, of the connection area between, the developing device 4 and the toner conveying passage 70 when the developing device 4 has been moved to the mounting/demounting position thereof, and FIG. 16 is a perspective view showing a positional relationship between the guide portion 26 and the shutter member 80 when the developing device 4 has been moved to the mounting/demounting position. When the support frame 41 (see FIG. 4) is moved in the arrow A' direction and the developing device 4 is mounted in the image forming apparatus 100, as shown in FIGS. 15 and 16, the end portion 70*a* of the toner conveying passage 70 is inserted into the guide portion 26 on a side toward the left therein as seen from the side of an opening of the guide portion 26.

At this time, the protrusion 83 of the shutter member 80 is fitted into the vertical groove portion 60*a* (see FIG. 12) of the guide groove 60, and the opening portion 81 is at a position separated by approximately 90° from the replenishment port 71 of the end portion 70*a*. That is, the replenishment port 71 is in a state of being closed by the shutter member 80.

Figure 17:
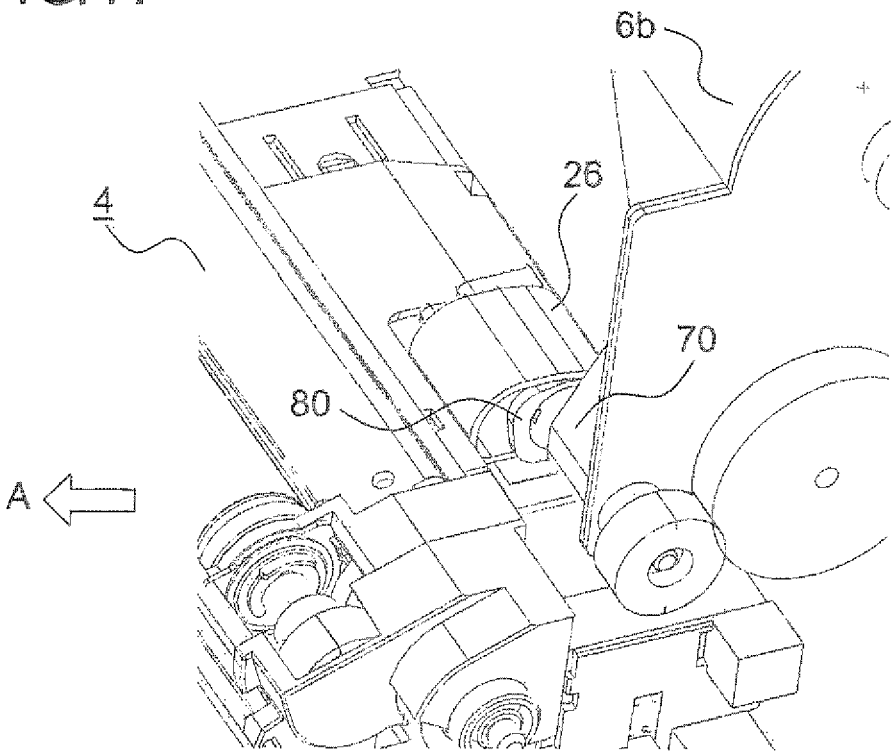
FIG. 17 is a perspective view, as seen from, above, of the connection area between the developing device 4 and the toner conveying passage 70 when the developing device 4 has been moved to a developing, position thereof.
Figure 18:
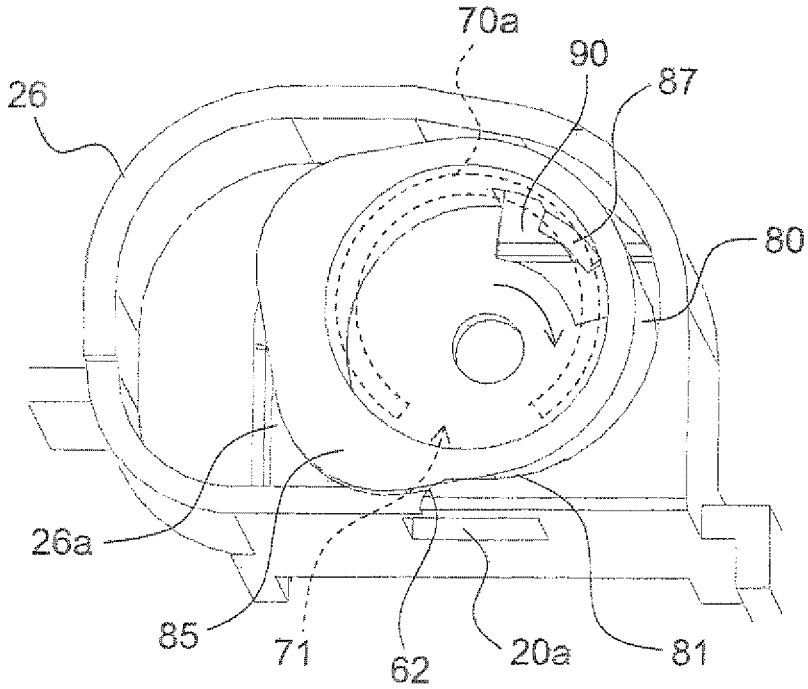
FIG. 18 is a perspective view showing a positional relationship between the guide portion 26 and the shutter member 80 when the developing device 4 has been moved to the developing position.

FIG. 17 is a perspective view, as seen from above, of the connection area between the developing device 4 and the toner conveying passage 70 when the developing device 4 has been moved to the developing position thereof, and FIG. 18 is a perspective view showing a positional relationship between the guide portion 26 and the shutter member 80 when the developing device 4 has been moved to the developing position. When, from the state shown in FIG. 15, the support frame 41 (see FIG. 4) is moved in the arrow A direction so that the developing device 4 is disposed at the developing position, the guide portion 26 of the developing device 4 also is moved in the arrow A direction. As the developing device 4 is moved, as shown in FIGS. 17 and 18, in the guide portion 26, the end portion 70*a* of the toner conveying passage 70 is relatively moved to the right side as seen from the side of the opening of the guide portion 26.

The shorter member 80 fitted around the end portion 70*a* makes a postural change into such a posture that, at the back in an insertion direction thereof, the protrusion 83 that has been fitted into the vertical groove portion 60*a* of the guide groove 60 is moved to the lateral groove portion 60*b* and thus is horizontally oriented. On the other hand, in front with respect to the insertion direction, the flange portion 85 rides up on the level difference portion 62. As a result, the shutter member 80 rotates in a clockwise direction in FIG. 18, so that the opening portion 81 is disposed at a position where it positionally coincides with the replenishment port 71, and thus the replenishment port 71 is opened. Furthermore, the end portion 70*a* is relatively moved within the guide portion 26 from, the left side toward the right side, so that the replenishment port 71 is disposed at a position where it is opposed to the toner supply port 20*a*. The toner conveying passage 70 thus communicates with, the developing device 4, so that toner replenishment from the toner conveying passage 70 to the developing device 4 is enabled.

On the other band, in a case of demounting the developing device 4 from the image forming apparatus 100, the developing device 4 is moved again to the mounting/demounting position shown in FIG. 15. Thus, in the guide portion 26, the end portion 70*a* of the toner conveying passage 70 is relatively moved to the left side as seen from the side of the opening of the guide portion 26, and the shutter member 80 rotates in a reverse direction, (a counterclockwise direction in FIG. 18), thus closing the replenishment port 71.

There exists, around the lug portion 87 of the shutter member 80, a slit 90 for allowing the lug portion 87 to be elastically deformed. Even though the shutter member 80 rotates between the position where the replenishment port 71 is closed (see FIG. 16) and the position where the replenishment port 71 is opened (see FIG. 18), the lug portion 87 and the silt 90 are always positioned on the upper side in the shutter member 80. This eliminates the possibility that toner in the toner conveying passage 70 leaks through the slit 90.

According to the above-described configuration, with the toner container 5 and the intermediate hopper 6 left mounted in the main body of the image forming apparatus 100, the developing device 4 can be disposed selectively at the developing position and at the mounting/demounting position. Furthermore, the toner container 5 and fee intermediate hopper 6 are not disposed at a position where they positionally coincide with a direction in which the developing device 4 is mounted/demounted (in front with, respect to the plane of FIG. 4), and thus die developing device 4 can be mounted/demounted without the need to demount the toner container 5 and the intermediate hopper 6. Thus, the developing device 4 and the toner container 5 can be mounted in/demounted from the image forming apparatus 100 independently of each other, so that the image forming apparatus 100 is improved in maintenance property.

Furthermore, when the developing device 4 is moved to the developing position or to the mounting/demounting position, the end portion 70*a* of the toner conveying passage 70 is relatively and horizontally moved within the guide portion 26, and thus a connected state between the end portion 70*a* (shutter member 80) and the guide portion 26 is maintained. This can effectively prevent occurrence of a connection failure between the toner conveying passage 70 and the developing device 4 due to the movement of the developing device 4. Furthermore, the intermediate hopper 6 is connected to the developing device 4 by use of fee toner conveying passage 70 having rigidity, so that connection strength between the toner conveying passage 70 and the intermediate hopper 6 or the developing device 4 can be increased.

Furthermore, the shutter member 80 closes the replenishment port 71 of the toner conveying passage 70 in tandem with the movement of the developing device 4 to the mounting/demounting position, and thus toner leakage through the replenishment port 71 at the time of mounting/demounting the developing device 4 can be reliably prevented. Furthermore, the shutter member 80 opens the replenishment port 71 of the toner conveying passage 70 in tandem with the movement of the developing device 4 to the developing position, and thus there is no possibility of forgetting to open the shutter member 80 at the time of toner replenishment.

Moreover, an operation direction (rotation direction) of the shutter member 80 is different from a movement direction (direction of arrows A and A') of the developing device 4, so that a load incurred by an opening/closing operation by the shutter member 80 does not affect a pressing force for keeping a constant positional relationship between the developing roller 25 and the photosensitive drum 1. This makes it possible to operate the shutter member 80 without affecting the positional relation ship between the developing roller 25 and the photosensitive drum 1 and thus can suppress occurrence of an image failure.

Furthermore, the shutter member 80 has, on an outer side of the tip end portion thereof in the insertion direction, the rib-shaped protrusion 83 that extends in the radial direction from the center axis, and the guide portion 26 has, on the inner wall surface thereof at the back in the insertion direction of the shutter member 80, the substantially L-shaped guide groove 60 with which the protrusion 83 is to be engaged. The shutter member 80 is configured to rotate such that it is relatively and horizontally moved within the guide portion 26, with the protrusion 83 being engaged with the guide groove 60. Thus, by using a simple configuration, the shutter member 80 can be rotated in tandem with its relative and horizontal movement within the guide portion 26. Moreover, the shutter member 80 is configured to rotate such that, when it is relatively and horizontally moved within the guide portion 26, the flange portion 85 rides up on the level difference portion 62. Thus, the rotation of the shutter member 80 can be guided at both end portions thereof in its axial direction, so that the shutter member 80 can be rotated more smoothly.

The present disclosure is not limited to the foregoing embodiment and may be variously modified within the spirit of the present disclosure. For example, while the foregoing embodiment describes the configuration using the developing device 4 shown in FIG. 2, which uses a magnetic one-component developer, there is no limitation thereto, and a developing device that uses a two-component developer made of toner and a carrier may be used. For example, the present disclosure is applicable also to a developing device in which a magnetic roller and a developing roller are used, and on the developing roller, only toner is moved to form a toner thin layer thereon, with the carrier being left on the magnetic roller. Furthermore, the toner container 5 also is not limited to the type shown in FIG. 10, in which toner inside the container main body 55 is moved, by rotating the container main body 55, and there may be adopted a type in which a paddle or spiral for conveying toner is disposed in a container main body.

The present disclosure is applicable to an image forming apparatus including a demountable developing device. Through the use of the present disclosure, there can be provided an image forming apparatus that achieves increased connection strength between a developer supply mechanism and a developing device, can effectively prevent occurrence of a connection failure between the developer supply mechanism and the developing device-due to the movement of the developing device to a developing position or to amounting/demounting position and developer leakage through a connection portion of the developer supply mechanism at the time of mounting/demounting, the developing device, and is excellent in maintenance property.

What is claimed is:

1. An image forming apparatus, comprising:

a developing device having a developer bearing member that is disposed so as to be opposed to an image bearing member on which an electrostatic latent image is formed and, at a region thereof opposed to the image bearing member, supplies a developer to the image bearing member;

a support frame that supports the developing device and is capable of disposing the developing device selectively at a mounting/demounting position where the developer bearing member is separated from the image bearing member and at a developing position where a developer can be supplied to the image bearing member;

a developer supply mechanism that supplies a developer to the developing device;

and a shutter member that is fitted around a connection portion of the developer supply mechanism at which the developer supply mechanism is connected to the developing device, and opens a replenishment port formed at the connection portion in tandem with movement of the developing device from the mounting/demounting position to the developing position and closes the replenishment port in tandem with movement of the developing device from the developing position to the mounting/demounting position, where a direction in which the developing device is moved, is different from a direction in which the: shutter member performs the opening/closing of the replenishment port, wherein the shutter member is a cylindrical member into which the connection portion is rotatably inserted and that has an opening portion formed on an outer peripheral surface thereof at a position that is to coincide with a position of the replenishment port, the developing device has a guide portion that has a substantially oval section and into which the shutter member is inserted, and the developing device is moved to and fro between the mounting/demounting position and the developing position, so that the shutter member is relatively and horizontally moved while rotating within the guide portion, and thus opens/closes the replenishment port.

2. The image forming apparatus according to claim 1, wherein the shutter member has, on an outer side of a tip end portion thereof in an insertion direction thereof, a rib-shaped protrusion that extends in a radial direction from a center axis thereof and is provided in a protruding manner, and the guide portion has, on an inner wall surface thereof at a back in the insertion direction of the shutter member, a substantially L-shaped guide groove with which the protrusion is to be engaged, and the shutter member rotates such that it is relatively and horizontally moved within the guide portion, with the protrusion being engaged with the guide groove.

3. The image forming apparatus according to claim 2, wherein when in a state of not being inserted into the guide portion, the shutter member is kept, by a biasing member, in such a posture that the protrusion is engageable with the guide groove.

4. The image forming apparatus according to claim 2, wherein the shutter member has, at part of an outer peripheral edge of a rear end portion thereof in the insertion direction, a flange portion that is provided in a protruding manner, and the guide portion has, at a lower portion of an opening edge thereof in front with respect to the insertion direction of the shutter member, a level difference portion with which, the flange portion is to be engaged, and the shutter member rotates such that, when it is relatively and horizontally moved within the guide portion, the flange portion rides up on the level difference portion.

5. The image forming apparatus according to claim 1, wherein the shutter member has a lug portion that rotatably engages the shutter member with the connection portion and prevents the shutter member from coming off from the connection portion.

6. The image forming apparatus according to claim 1, wherein the developer supply mechanism is disposed at a position where it does not positionally coincide with a direction in which the developing device is mounted/demounted.

* * * * *